US011180959B2

(12) United States Patent
Jathmi

(10) Patent No.: US 11,180,959 B2
(45) Date of Patent: Nov. 23, 2021

(54) WELLBORE DRILL BIT

(71) Applicant: Saudi Arabian Oil Company, Dhahran (SA)

(72) Inventor: Mohammed A. Jathmi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 215 days.

(21) Appl. No.: 16/358,166

(22) Filed: Mar. 19, 2019

(65) Prior Publication Data

US 2020/0300045 A1 Sep. 24, 2020

(51) Int. Cl.
*E21B 10/18* (2006.01)
*E21B 10/60* (2006.01)

(52) U.S. Cl.
CPC ..... *E21B 10/18* (2013.01); *E21B 10/60* (2013.01); *E21B 10/602* (2013.01)

(58) Field of Classification Search
CPC ..... E21B 10/60; E21B 10/602; E21B 10/61; E21B 10/08; E21B 10/18
See application file for complete search history.

(56) References Cited

U.S. PATENT DOCUMENTS 2,776,115 A 1/1957 Williams
3,746,108 A 7/1973 Hall
4,185,706 A 1/1980 Baker, III et al.
4,336,850 A * 6/1982 Fielder ..... B01D 29/44 175/393
4,372,399 A 2/1983 Cork
4,515,229 A * 5/1985 Drummond ..... E21B 21/16 175/337
5,730,222 A 3/1998 Rike, Jr.
5,775,443 A * 7/1998 Lott ..... E21B 10/18 175/340

(Continued)

FOREIGN PATENT DOCUMENTS

CN 10261837 8/2012
EP 959224 11/1999

(Continued)

OTHER PUBLICATIONS

PCT International Search Report and Written Opinion in International Appln. No. PCT/US2020/022624, dated Jun. 29, 2020, 15 pages.

(Continued)

*Primary Examiner* — George S Gray
(74) *Attorney, Agent, or Firm* — Fish & Richardson P.C.

(57) ABSTRACT

A wellbore drill bit includes a body that defines an inner volume and includes a top sub-assembly, and a plurality of cutting cones along a longitudinal axis of the body. The wellbore drill bit includes a chamber positioned in the inner volume of the body to form an annulus between the chamber and the body; a first set of nozzles positioned in the plurality of cutting cones, each nozzle of the first set of nozzles including a fluid entry that is fluidly coupled to a primary drilling fluid flow path, and a fluid exit oriented toward the second longitudinal end of the body; and a second set of nozzles positioned in the body. Each nozzle of the second set of nozzles includes a fluid entry that is fluidly coupled to the annulus, and a fluid exit oriented toward the first longitudinal end of the body.

20 Claims, 3 Drawing Sheets

(56) References Cited

U.S. PATENT DOCUMENTS

2016/0177630 A1 6/2016 Trunk

FOREIGN PATENT DOCUMENTS

| | | |
|---|---|---|
| FR | 2277968 | 2/1976 |
| GB | 2277758 | 11/1994 |

OTHER PUBLICATIONS

John Mitchell, "Trouble-Free Drilling" vol. 1: Stuck Pipe Prevention, pp. 36, 39-40, 45-47, 49-51, 99, Drilbert Engineering Inc., 2002, 12 pages.

Van Dyke, "Rotary Driling: The Bit," Fourth Edition, Unit I, Lesson 2, pp. 25, 27, 28, 29, 30, the University of Texas at Austin, 1995, 7 pages.

* cited by examiner

WELLBORE DRILL BIT

TECHNICAL FIELD

This disclosure relates to a wellbore drill bit.

BACKGROUND

Drilling fluids are used during drilling of subterranean wells. The drilling fluid provides primary well control of subsurface pressures by a combination of density and any additional pressure acting on the fluid column. The drilling fluid is circulated downhole through a drilling string, into and out of a drill bit, and uphole in an annulus to a surface so that drill cuttings are removed from the wellbore.

SUMMARY

In an example implementation, a wellbore drill bit assembly includes a body that defines an inner volume and includes a top sub-assembly at a first longitudinal end of the body that is configured to couple to a drilling string, and a plurality of cutting cones at a second longitudinal end of the body opposite the first longitudinal end along a longitudinal axis of the body. The wellbore drill bit assembly further includes a chamber positioned in the inner volume of the body to form an annulus between the chamber and the body. The chamber includes a primary drilling fluid flow path. The wellbore drill bit assembly further includes a first set of nozzles positioned in the plurality of cutting cones, each nozzle of the first set of nozzles including a fluid entry that is fluidly coupled to the primary drilling fluid flow path, and a fluid exit oriented toward the second longitudinal end of the body. The wellbore drill bit assembly further includes a second set of nozzles positioned in the body, each nozzle of the second set of nozzles including a fluid entry that is fluidly coupled to the annulus, and a fluid exit oriented toward the first longitudinal end of the body.

In an aspect combinable with the example implementation, the chamber is integrally formed with the body.

In another aspect combinable with any of the previous aspects, the chamber includes a conical chamber with a top portion that forms the annulus between the conical chamber and the body.

In another aspect combinable with any of the previous aspects, the second set of nozzles includes three nozzles.

In another aspect combinable with any of the previous aspects, each of the three nozzles of the second set of nozzles is radially oriented 120 degrees apart of the other two of the three nozzles on the body.

In another aspect combinable with any of the previous aspects, at least one of the nozzles of the second set of nozzles includes a screen.

In another aspect combinable with any of the previous aspects, a total flow area of the first set of nozzles is between four and nine times a total flow area of the second set of nozzles.

In another aspect combinable with any of the previous aspects, the wellbore drill bit includes a tri-cone drill bit or a polycrystalline diamond compact (PDC).

In another example implementation, a wellbore drilling method includes circulating a drilling fluid through a drilling string and to a wellbore drill bit coupled to the drilling string in a wellbore; circulating the drilling fluid into an uphole end of a body of the wellbore drill bit that includes a plurality of cutting cones at a downhole end of the body opposite the uphole end of the body; directing a first portion of the drilling fluid from the uphole end of the body into a primary drilling fluid flow path defined in a chamber that is positioned within the body of the wellbore drill bit; directing the first portion of the drilling fluid from the primary drilling fluid flow, through a first set of nozzles positioned above the plurality of cutting cones, and out of the first set of nozzles in a downhole direction in the wellbore; directing a second portion of the drilling fluid from the uphole end of the body into an annulus defined between the chamber and the body of the wellbore drill bit; and directing the second portion of the drilling fluid from the annulus, through a second set of nozzles positioned in the body, and out of the second set of nozzles in an uphole direction in the wellbore.

In an aspect combinable with the example implementation, the second set of nozzles includes three nozzles, and each of the three nozzles of the second set of nozzles is radially oriented 120 degrees apart of the other two of the three nozzles on the body.

Another aspect combinable with any of the previous aspects further includes directing the second portion of the drilling fluid through the three nozzles and out of the three nozzles of the second set of nozzles in the uphole direction in the wellbore.

In another aspect combinable with any of the previous aspects, the second portion of the drilling fluid is between 10-20% of the drilling fluid circulated to the wellbore drilling bit, and the first portion of the drilling fluid is between 80-90% of the drilling fluid circulated to the wellbore drilling bit.

In another aspect combinable with any of the previous aspects, the uphole direction is oriented 180 degrees from the downhole direction.

Another aspect combinable with any of the previous aspects further includes filtering the second portion of drilling fluid through one or more screens mounted in the second set of nozzles.

Another aspect combinable with any of the previous aspects further includes removing cuttings from the wellbore toward an uphole end of the wellbore with the first and second portions of drilling fluid.

In another example implementation, a wellbore drill bit includes a body including a first end configured to couple to a drilling string and a second end including a plurality of cutting cones, the body including an inlet sized to receive a flow of a drilling fluid; a flow divider positioned in the body and fluidly coupled to the inlet of the body, the flow divider defining a first drilling fluid flow path through the body and a second drilling fluid flow path through the body; a plurality of downhole nozzles positioned above the plurality of cutting cones, each downhole nozzle fluidly coupled to the first drilling fluid flow path and having an outlet oriented toward the second end of the body; and a plurality of uphole nozzles positioned through the body, each uphole nozzle fluidly coupled to the second drilling fluid flow path and having an outlet oriented toward the first end of the body.

In an aspect combinable with the example implementation, the respective outlets of the downhole nozzles and the uphole nozzles are oriented about 180 degrees apart.

In another aspect combinable with any of the previous aspects, the first fluid flow path is defined through an interior volume of the flow divider.

In another aspect combinable with any of the previous aspects, the second drilling fluid flow path is defined between the flow divider and the body.

In another aspect combinable with any of the previous aspects, the flow divider includes a tapered conical shape.

Implementations of a wellbore drill bit according to the present disclosure may include one or more of the following features. For example, the wellbore drill bit may enhance drilling operation efficiency and rate of penetration (ROP) relative to conventional drilling bits. As another example, the wellbore drill bit may help avoid lost time for cleaning trips or fishing a stuck drill bit out of a wellbore by reducing a chance of a stuck drilling string in the wellbore. As a further example, the wellbore drilling bit may help avoid back reaming in some conditions. As further examples, the wellbore drill bit may enhance hole cleaning for hard and moderate formations, avoid torque increasing and drag over a period of time during the drilling operation, and avoid increasing a drilling fluid pump pressure without changing any drilling fluid properties. As another example, the wellbore drill bit may, when used with a "mud motor," help reduce situations common to mud motor usage, including ineffective removal of cuttings and stuck drilling string situations. As a further example, the wellbore drilling bit may clear a pathway for fluid flow and improve permeability in a worst-case scenario once an acid job has been completed.

The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

Figure 1:
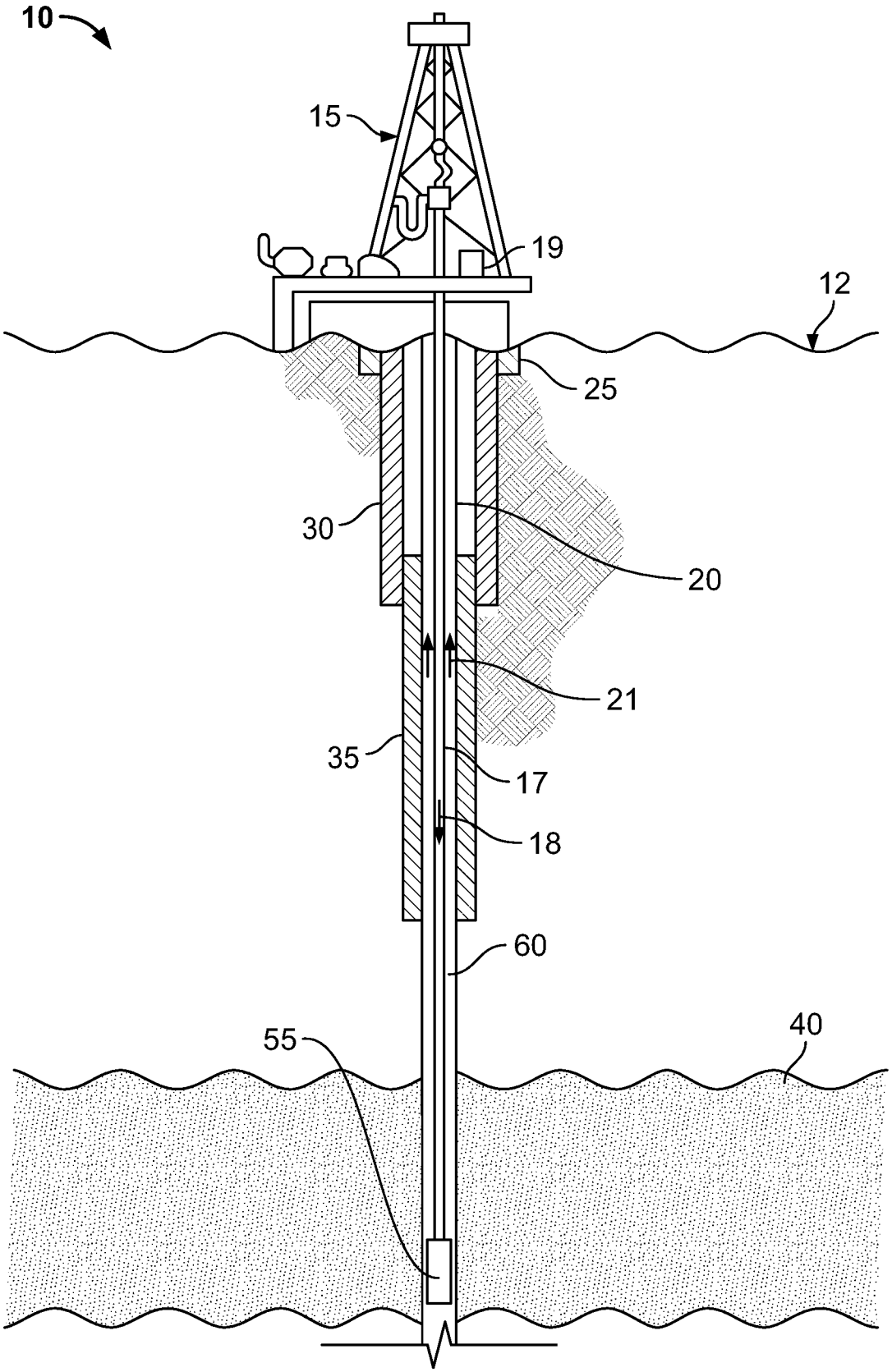
FIG. 1 is a schematic diagram of an example wellbore system that includes a wellbore drill bit according to the present disclosure.

FIG. 1 is a schematic diagram of an example wellbore system 10 that includes a wellbore drill bit according to the present disclosure. Generally, FIG. 1 illustrates a portion of one embodiment of a wellbore system 10 according to the present disclosure in which a wellbore drill bit ("drill bit") includes one or more nozzles that direct drilling fluid out of the bit and into a wellbore in a downhole direction (for example, during the drilling process) and one or more nozzles that direct drilling fluid from the bit and into the wellbore in an uphole direction. In some aspects, implementations of the drill bit according to the present disclosure may effectively combines uphole-directed nozzles and downhole-directed nozzles better remove cuttings toward a terranean surface, thereby cleaning and improving a drilling rate. For example, in geologic formations (for example, hard limestone, dolomite, hard sands) in which typical ROP is reduced, the arrangement of the uphole nozzles may provide increased ejection of the cuttings and keep the cuttings away from the cutting cones (for example, bit teeth) of the drill bit. In some aspects, therefore, drilling energy, re-drill of the cuttings, and drill bit wear may be reduced.

As shown, the wellbore system 10 accesses a subterranean formation 40, and provides access to hydrocarbons located in such subterranean formation 40. In an example implementation of system 10, the system 10 may be used for a drilling operation in which a downhole tool 55 may include or be coupled with a wellbore drill bit of the present disclosure, such as wellbore drill bit 100 shown in FIGS. 2A-2C. As illustrated in FIG. 1, an implementation of the wellbore system 10 includes a drilling assembly 15 deployed on a terranean surface 12. The drilling assembly 15 may be used to form a wellbore 20 extending from the terranean surface 12 and through one or more geological formations in the Earth. One or more subterranean formations, such as subterranean formation 40, are located under the terranean surface 12. One or more wellbore casings, such as a surface casing 30 and intermediate casing 35, may be installed in at least a portion of the wellbore 20.

In some embodiments, the drilling assembly 15 may be deployed on a body of water rather than the terranean surface 12. For instance, in some embodiments, the terranean surface 12 may be beneath an ocean, gulf, sea, or any other body of water under which hydrocarbon-bearing formations may be found. In short, reference to the terranean surface 12 includes both land and underwater surfaces and contemplates forming and developing one or more wellbore systems 10 from either or both locations.

Generally, as a drilling system, the drilling assembly 15 may be any appropriate assembly or drilling rig used to form wellbores or boreholes in the Earth. The drilling assembly 15 may use traditional techniques to form such wellbores, such as the wellbore 20, or may use nontraditional or novel techniques. In some embodiments, the drilling assembly 15 may use rotary drilling equipment to form such wellbores. Rotary drilling equipment is known and may consist of a drilling string 17 and the downhole tool 55 (for example, a bottom hole assembly and bit). In some embodiments, the drilling assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drilling string 17. The drilling string 17 is typically attached to the drill bit within the downhole tool 55 (for example, bottom hole assembly).

The drilling string 17 typically consists of sections of heavy steel pipe, which are threaded so that they can interlock together. Below the drill pipe are one or more drill collars, which are heavier, thicker, and stronger than the drill pipe. The threaded drill collars help to add weight to the drilling string 17 uphole of the drill bit to ensure that there is enough downward force on the drill bit to allow the bit to drill through the one or more geological formations. The number and nature of the drill collars on any particular rotary rig may be altered depending on the downhole conditions experienced while drilling.

The circulating system of a rotary drilling operation, such as the drilling assembly 15, may be an additional component of the drilling assembly 15. Generally, the circulating system may cool and lubricate the drill bit, removing the cuttings from the drill bit and the wellbore 20 (for example, through an annulus 60), and coat the walls of the wellbore 20 with a mud type cake. The circulating system consists of drilling fluid 18, which is circulated down through the drilling string 17 throughout the drilling process. The drilling fluid 18 (or "drilling mud") circulated to the drill bit and out of the drill bit into the annulus 60 (shown as drilling fluid 21), where the drilling fluid 21 returns to the terranean surface 12. Typically, the components of the circulating system include drilling fluid pumps, compressors, related plumbing fixtures, and specialty injectors for the addition of additives to the drilling fluid. In some embodiments, such as, for example, during a horizontal or directional drilling process, downhole motors may be used in conjunction with or in the downhole tool 55. Such a downhole motor may be a mud motor with a turbine arrangement, or a progressive cavity arrangement, such as a Moineau motor. These motors receive the drilling fluid through the drilling string 17 and rotate to drive the drill bit or change directions in the drilling operation.

In many rotary drilling operations, the drilling fluid 18 is pumped down the drilling string 17 and out through ports or jets in the drill bit. The drilling fluid 21 (which includes cuttings) then flows up toward the surface 12 within annulus 60 between the wellbore 20 and the drilling string 17, carrying cuttings in suspension to the surface. The drilling fluid, much like the drill bit, may be chosen depending on the type of geological conditions found under subterranean surface 12.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

In some aspects, the drilling assembly 15 (or other portion of the well system 10) may include a control system 19, for example, microprocessor-based, electro-mechanical, or otherwise, that may control the downhole tool 55 including the drill bit. In some aspects, the control system 19 may control one or more pumps, one or more valves, as well as other equipment that is part of or connected to the drilling fluid circulation system. For example, the control system 19 may control a flow rate, pressure, or other circulation criteria of the drilling fluid 18. In some aspects, the control system 19 may also control a composition of the drilling fluid 18, such as, a water percentage of the fluid, or an additive that may be mixed with the drilling fluid 18.

Figure 2A:
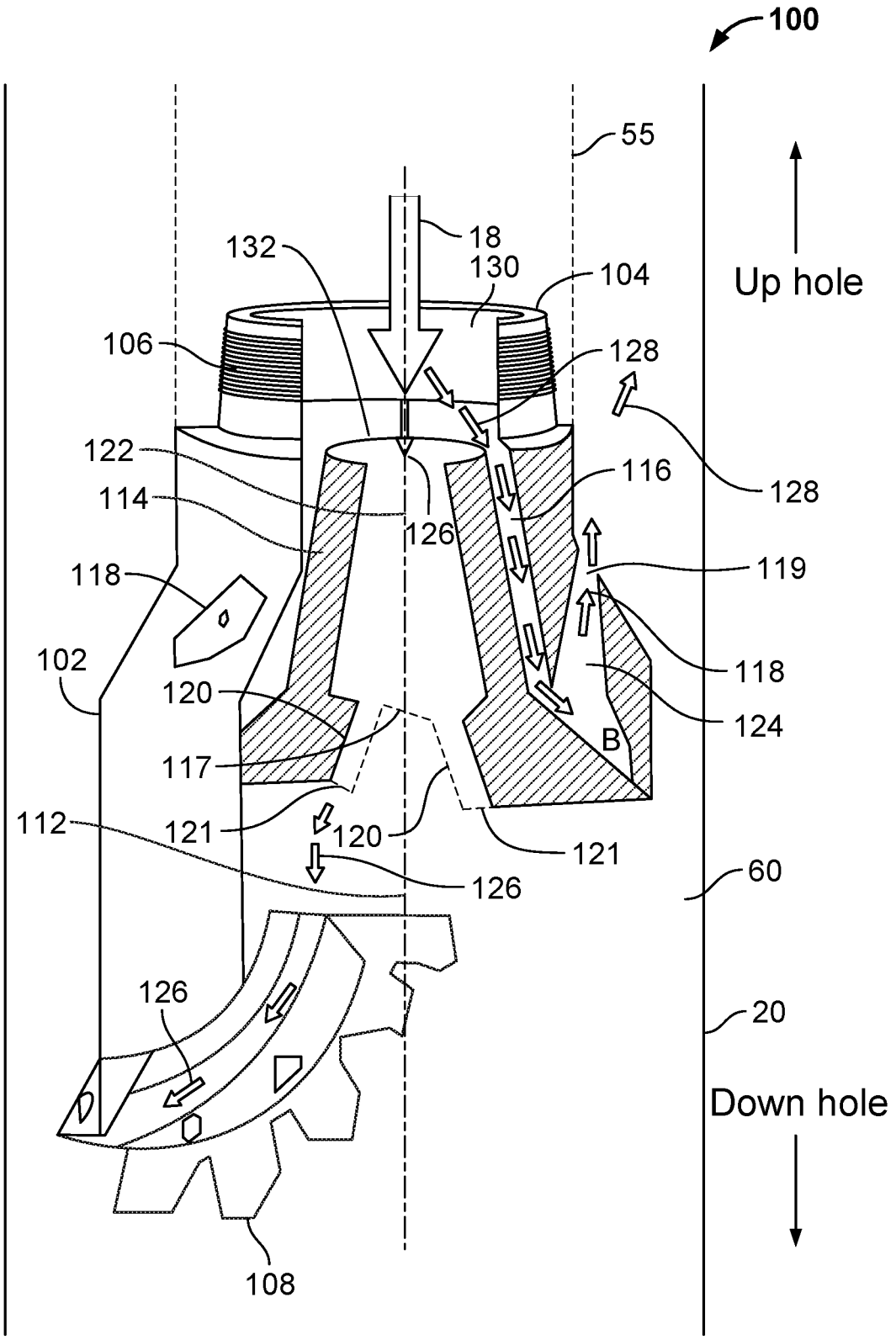
FIGS. 2A-2C are schematic, partial cross-sectional view, top view, and side sectional view, respectively, of a wellbore drill bit according to the present disclosure.
Figure 2B:
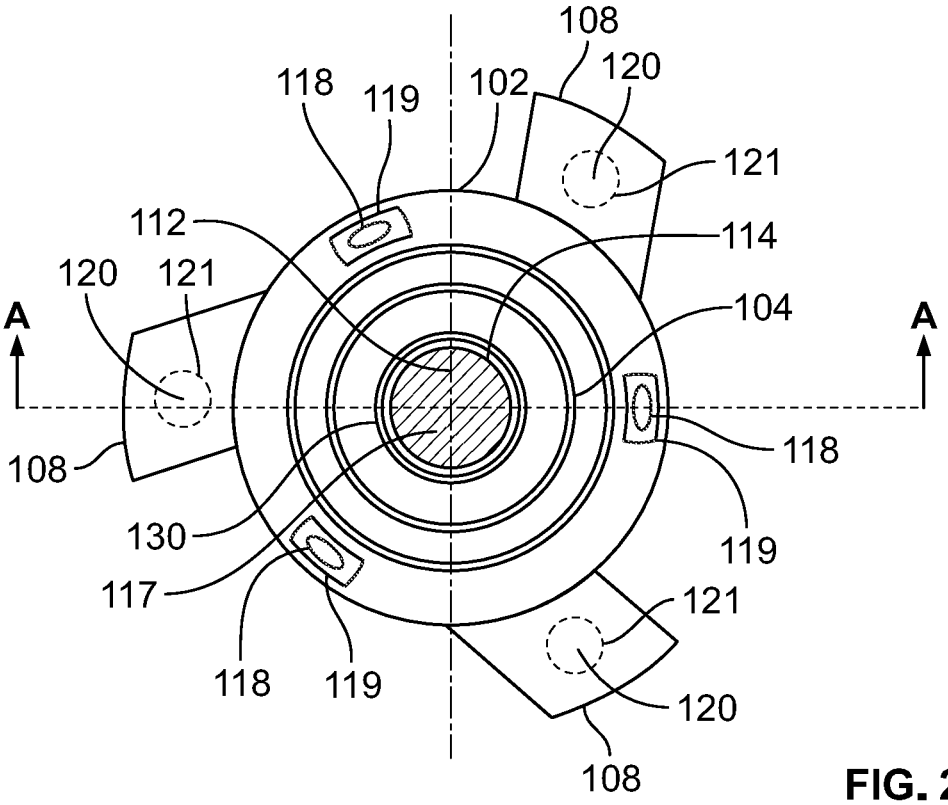
Figure 2C:
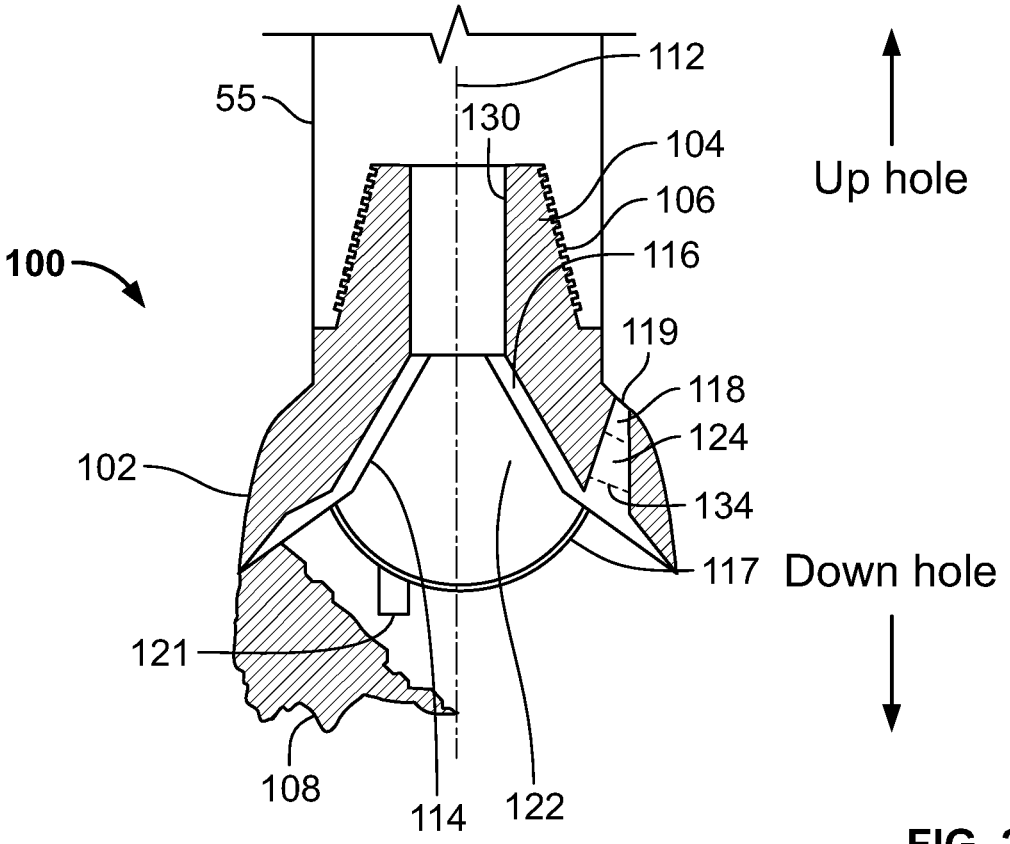

FIGS. 2A-2C are schematic, partial cross-sectional diagrams of a wellbore drill bit 100 according to the present disclosure. FIG. 2A shows a side view of the drill bit 100 with a portion cut-away. FIG. 2B shows a top view of the drill bit 100. FIG. 2C shows a side-sectional view of the wellbore drill bit 100 taken along the A-A line from FIG. 2B. As shown in these figures, the wellbore drill bit 100 includes a body 102 that defines an inner volume 132. The wellbore drill bit 100 is illustrated in FIG. 2A as oriented in the wellbore 20 and connected to the BHA 55 (which in turn is coupled to the drilling string 17, not shown here). An axis 112 is shown in FIG. 2A and FIG. 2C that extends longitudinally (as shown, vertically when oriented in a vertical wellbore 20) through the body 102.

The axis 112 extends from a top, or uphole, end of the wellbore drill bit 100 to a bottom, or downhole, end of the wellbore drill bit 100. At the top, or uphole, end is a top sub-assembly ("sub") 104, which includes, in this example implementation of the wellbore drill bit 100, a threaded connection 106. In some aspects, therefore, the wellbore drill bit 100 may couple to the BHA 55 (or with the drilling string 17) through the threaded connection 106. As shown, the top sub 104 includes a bore 130 (for example, a circular bore) that allows the wellbore drill bit 100 to fluidly couple to the drilling string 17 to receive a flow of drilling fluid for drilling operations. For example, as shown in FIG. 2A, the drilling fluid 18 may enter the wellbore drill bit 100 through the bore 130 of the top sub 104.

The body 102 of the illustrated wellbore drill bit 100 includes cutting cones (or bit teeth) 108 that are designed to cut, crush, or otherwise remove rock pieces from a rock formation during drilling operation so as to form a wellbore. In the illustrated example, the wellbore drill bit 100 is a tri-cone drill bit in that there are three cutting cones 108 (shown best in FIG. 2B) that are radially positioned around the wellbore drill bit 100 at 120 degrees apart from each other (configurable based on bit design). This radial spacing is an example and other radial spacings are possible depending on the wellbore drill bit design. Other forms of drilling bits may also be used as wellbore drill bit 100 with respect to the type of cutting cones 108 employed by the bit. As illustrated, the cutting cones 108 are positioned on the wellbore drill bit 100 (for example, rotatable) at a bottom, or downhole, end of the wellbore drill bit 100 (opposite the top sub 104).

As shown in FIGS. 2A-2C, a chamber 114 is positioned in the inner volume 132 of the body 102 of the wellbore drill bit 100. In some aspects, the chamber 114 is formed integrally with, and of the same material as, the body 102. As illustrated, the chamber 114 is a generally conical shape, with a narrow portion near the top end of the body 102 and a wider, expanded portion extending through the inner volume 132 toward the bottom end of the body 120. As shown, a longitudinal center-line axis of the chamber 114 is aligned with the axis 112 of the body 102.

A primary drilling fluid flow path 122 is defined within an interior space of the chamber 114, as shown in FIGS. 2A and 2C. The chamber 114 is also positioned in the inner volume 132 of the body 102 to form an annulus 116 between the chamber 114 and the body 102 (as shown in FIGS. 2A and 2C). A secondary drilling fluid flow path 124 is formed in the annulus 116 and within the body 102 as shown in FIGS. 2A and 2C.

As shown in FIG. 2A, each cutting cone 108 is topped with a nozzle 120 (for example, a "downhole nozzle") that extends through the cutting cone 108 and is fluidly coupled to the primary drilling fluid flow path 122 (but fluidly decoupled from the secondary drilling fluid flow path 124 and the annulus 116). As shown in FIG. 2A, the nozzle 120 extends through the drilling fluid flow path 122 in which the chamber 114 is positioned and is coupled to a bottom portion of the chamber 114. Thus, in this example, the nozzles 120 are coupled to the chamber 114 near a bottom bit belly 117 (also shown in FIG. 2C) of the wellbore bit 100 to receive the primary drilling fluid 126 circulated through the chamber 114. As shown, the chamber 114 is attached to or coupled with the bit housing 102 at the bottom bit belly 117.

The nozzle 120 (and each nozzle 120 in the case of multiple (for example, three) cutting cones 108) is positioned at or near the bottom bit belly 117, above the cutting cone 108, and terminates in an outlet 121. As shown, each outlet 121 is oriented in a downhole direction, such that any drilling fluid that flows out of the outlet 121 is directed toward the bottom end of the body 102 of the wellbore drill bit 100 (in other words, in a downhole direction). Thus, the orientation of the outlet 121 of the nozzle 120 is in a direction parallel or close to parallel (e.g., differing by 5-20 degrees) to the axis 112 and in a downhole direction.

As shown in FIG. 2A, a nozzle 118 (for example, an "uphole nozzle") extends within the annulus 116 and through the body 102 of the wellbore drill bit 100 between the top end and the bottom end of the body 102. The nozzle 118 is fluidly coupled to the secondary drilling fluid flow path 124 through the annulus 116 (but fluidly decoupled from the primary drilling fluid flow path 122). The nozzle 118 (and each nozzle 118 in the case of multiple (for example, three) nozzles 118) extends through the body 102 and terminates in an outlet 119. As shown in FIGS. 2A and 2B, each outlet 119 is oriented in an uphole direction, such that any drilling fluid that flows out of the outlet 119 is directed toward the top end of the body 102 of the wellbore drill bit 100 (in other words, in an uphole direction). Thus, the orientation of the outlet 119 of the nozzle 118 is in a direction parallel to the axis 112 and in an uphole direction. In some aspects, therefore, the outlets 119 and 121 are oriented in vertically opposite directions, such as 180 degrees or close to 180 degrees (for example, within 5-10 degrees) apart.

As shown in FIG. 2B, in this example implementation, there may be three nozzles 118 (each with an outlet 119). The three nozzles 118 may be oriented on the body 102 of the wellbore drill bit 100 in a radial spacing of 120 degrees apart, as shown. Further, as shown in FIG. 2C, a filter 134 (for example, a screen) may be mounted in each secondary drilling fluid flow path 124. In some aspects, the filter 134 may prevent or reduce cuttings from entering the outlet 119 or clogging the nozzle 118.

In an example operation of the wellbore drill bit 100 and with reference to FIGS. 2A-2C, during a drilling operation, the drilling fluid 18 is circulated through the drilling string 17 and to the BHA 55. The drilling fluid 18 is circulated into the wellbore drill bit 100 through the bore 130 of the top sub 104 of the wellbore drill bit 100. As the drilling fluid 18 enters the body 102, the drilling fluid 18 is split at the chamber 114 into a primary drilling fluid 126 and a secondary drilling fluid 128. The primary drilling fluid 126 enters the primary drilling fluid flow path 122 in the interior of the chamber 114. The secondary drilling fluid 128 enters the secondary drilling fluid flow path 124 in the annulus 116 between the chamber 114 and the body 116. In some aspects, a volumetric flow rate of the primary drilling fluid 126 is between about 80-90% of the volumetric flow rate of the drilling fluid 18 provided to the wellbore drill bit 100. In some aspects, a volumetric flow rate of the secondary drilling fluid 128 is between about 10-20% of the volumetric flow rate of the drilling fluid 18 provided to the wellbore drill bit 100. These percentages can be adjusted, for example, by the size or position (or both) of the chamber 114 in the inner volume 132 of the body 102. For example, the size or position (or both) of the chamber 114 can be adjusted to enlarge a flow area cross-section of the annulus 116 (by decreasing a flow area cross-section of the primary drilling fluid flow path 122). This would increase the volumetric flow rate of the secondary drilling fluid 128 relative to the volumetric flow rate of the primary drilling fluid 126. Alternatively, the size or position (or both) of the chamber 114 can be adjusted to decrease the flow area cross-section of the annulus 116 (and increase the flow area cross-section of the primary drilling fluid flow path 122). This would decrease the volumetric flow rate of the secondary drilling fluid 128 relative to the volumetric flow rate of the primary drilling fluid 126.

Continuing with the example operation, the primary drilling fluid 126 flows through the primary drilling fluid flow path 122 and into the nozzles 120. As the wellbore drill bit 100 is cutting the rock formation, the primary drilling fluid 126 flows into the wellbore 20 in a downhole direction through the outlets 121. In some aspects, the flow of primary drilling fluid 126 out of the wellbore drill bit 100 in the downhole direction functions to lubricate and cool the cutting cones 108 and push cuttings to a side of the wellbore drill bit 100 in the annulus 60, thereby carrying the cuttings in an uphole direction in the annulus 60.

Continuing with the example operation, the secondary drilling fluid 128 flows through the secondary drilling fluid flow path 124 and into the nozzles 118. As the wellbore drill bit 100 is cutting the rock formation, the secondary drilling fluid 128 flows into the wellbore 20 in an uphole direction through the outlets 119. In some aspects, the flow of secondary drilling fluid 128 out of the wellbore drill bit 100 in the uphole direction functions to further push cuttings uphole of the wellbore drill bit 100 in the annulus 60, thereby preventing or helping to prevent the cuttings from causing the wellbore drill bit 100 to become stuck in the wellbore 20 (as one example benefit). Eventually, the primary and secondary drilling fluids 126 and 128 mix in the annulus 60 as drilling fluid 21, which is circulated uphole (with the cuttings) to the terranean surface 12. Cuttings are removed from the primary and secondary drilling fluids 126 and 128, which are combined as drilling fluid 18 and circulated back downhole in the drilling string 17.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A wellbore drill bit, comprising:

a body that defines an inner volume, the body comprising:

a top sub-assembly at a first longitudinal end of the body and configured to couple to a drilling string, and a plurality of cutting cones at a second longitudinal end of the body opposite the first longitudinal end along a longitudinal axis of the body;

a chamber positioned in the inner volume of and integrally formed with the body to form an annulus between the chamber and the body, the chamber comprising a primary drilling fluid flow path;

a first set of nozzles positioned in the plurality of cutting cones, each nozzle of the first set of nozzles positioned in one of the plurality of cutting cones and comprising a fluid entry that is fluidly coupled to the primary drilling fluid flow path, and a fluid exit oriented toward the one of the plurality of cutting cones and toward the second longitudinal end of the body; and a second set of nozzles positioned in the body, each nozzle of the second set of nozzles comprising a fluid entry that is fluidly coupled to the annulus, and a fluid exit oriented toward the first longitudinal end of the body.

2. The wellbore drill bit assembly of claim 1, wherein the chamber comprises a conical chamber with a top portion that forms the annulus between the conical chamber and the body.

3. The wellbore drill bit assembly of claim 1, wherein the second set of nozzles comprises three nozzles.

4. The wellbore drill bit assembly of claim 3, wherein each of the three nozzles of the second set of nozzles is radially oriented 120 degrees apart of the other two of the three nozzles on the body.

5. The wellbore drill bit assembly of claim 4, wherein a total flow area of the first set of nozzles is between four and nine times a total flow area of the second set of nozzles.

6. The wellbore drill bit assembly of claim 1, wherein at least one of the nozzles of the second set of nozzles comprises a screen.

7. The wellbore drill bit assembly of claim 1, wherein a total flow area of the first set of nozzles is between four and nine times a total flow area of the second set of nozzles.

8. The wellbore drill bit assembly of claim 1, wherein the wellbore drill bit comprises a tri-cone drill bit.

9. A wellbore drilling method, comprising:

circulating a drilling fluid through a drilling string and to a wellbore drill bit coupled to the drilling string in a wellbore;

circulating the drilling fluid into an uphole end of a body of the wellbore drill bit that comprises a plurality of cutting cones at a downhole end of the body opposite the uphole end of the body;

directing a first portion of the drilling fluid from the uphole end of the body into a primary drilling fluid flow path defined in a chamber that is positioned within the body of the wellbore drill bit;

directing the first portion of the drilling fluid from the primary drilling fluid flow, through a first set of nozzles positioned above the plurality of cutting cones, and out of the first set of nozzles in a downhole direction in the wellbore;

directing a second portion of the drilling fluid from the uphole end of the body into an annulus defined between the chamber and the body of the wellbore drill bit; and directing the second portion of the drilling fluid from the annulus, through a second set of nozzles positioned in the body, and out of the second set of nozzles in an uphole direction in the wellbore.

10. The wellbore drilling method of claim 9, wherein the second set of nozzles comprises three nozzles, and each of the three nozzles of the second set of nozzles is radially oriented 120 degrees apart of the other two of the three nozzles on the body.

11. The wellbore drilling method of claim 10, further comprising directing the second portion of the drilling fluid through the three nozzles and out of the three nozzles of the second set of nozzles in the uphole direction in the wellbore.

12. The wellbore drilling method of claim 9, wherein the second portion of the drilling fluid is between 10-20% of the drilling fluid circulated to the wellbore drilling bit, and the first portion of the drilling fluid is between 80-90% of the drilling fluid circulated to the wellbore drilling bit.

13. The wellbore drilling method of claim 9, wherein the uphole direction is oriented 180 degrees from the downhole direction.

14. The wellbore drilling method of claim 9, further comprising filtering the second portion of drilling fluid through one or more screens mounted in the second set of nozzles.

15. The wellbore drilling method of claim 9, further comprising removing cuttings from the wellbore toward an uphole end of the wellbore with the first and second portions of drilling fluid.

16. A wellbore drill bit, comprising:

a body comprising a first end configured to couple to a drilling string and a second end comprising a plurality of cutting cones, the body comprising an inlet sized to receive a flow of a drilling fluid;

a flow divider positioned in and integrally formed with the body and fluidly coupled to the inlet of the body, the flow divider defining a first drilling fluid flow path through the body and a second drilling fluid flow path through the body;

a plurality of downhole nozzles positioned above the plurality of cutting cones, each downhole nozzle fluidly coupled to the first drilling fluid flow path and having an outlet oriented toward the second end of the body; and a plurality of uphole nozzles positioned through the body, each uphole nozzle fluidly coupled to the second drilling fluid flow path and having an outlet oriented toward the first end of the body.

17. The wellbore drill bit of claim 16, wherein the respective outlets of the downhole nozzles and the uphole nozzles are oriented about 180 degrees apart.

18. The wellbore drill bit of claim 16, wherein the first fluid flow path is defined through an interior volume of the flow divider.

19. The wellbore drill bit of claim 18, wherein the second drilling fluid flow path is defined between the flow divider and the body.

20. The wellbore drill bit of claim 16, wherein the flow divider comprises a tapered conical shape.

* * * * *